United States Patent [19]

Kulesza et al.

[11] Patent Number: 4,900,026

[45] Date of Patent: Feb. 13, 1990

[54] WHIRLING BALL COLLECTING GAME

[75] Inventors: Ralph J. Kulesza, Chicago; Walter J. Wozniak, Addison; Jeffrey D. Breslow, Highland Park, all of Ill.

[73] Assignee: Marvin Glass & Associates, Chicago, Ill.

[21] Appl. No.: 135,388

[22] Filed: Dec. 21, 1987

[51] Int. Cl.[4] ..... A63D 3/02; A63B 71/00; A63B 67/00

[52] U.S. Cl. ..... 273/119 A; 273/129 T; 273/1 GD; 273/1 GE; 273/148 R

[58] Field of Search ..... 273/1 G, 1 GC, 1 GE, 273/1 GG, 119 R, 119 A, 129 V, 129 R, 129 T, 271, 119, 129, 1 GD

[56] References Cited

U.S. PATENT DOCUMENTS

| | | | |
|---|---|---|---|
| 2,431,121 | 11/1947 | Hunter | 273/148 R |
| 2,520,321 | 8/1950 | McDonald et al. | 273/148 R |
| 2,949,682 | 8/1960 | Humbert | 273/118 R |
| 3,203,699 | 8/1965 | Pearson | 273/129 R |
| 3,208,185 | 9/1965 | Silvera | 273/129 R |
| 3,643,954 | 2/1972 | Meyer et al. | 273/129 V |
| 3,679,208 | 7/1972 | Carrano | 273/144 R |
| 4,111,429 | 9/1978 | Waski | 273/144 A |
| 4,119,312 | 10/1978 | Todokoro | 273/120 R |
| 4,128,246 | 12/1978 | Hicks et al. | 273/243 |
| 4,210,331 | 7/1980 | Kulesza et al. | 273/123 R |
| 4,412,682 | 11/1983 | Rehkemper et al. | 273/1 GG |

*Primary Examiner*—Edward M. Coven
*Assistant Examiner*—Gary Jackson
*Attorney, Agent, or Firm*—John S. Pacocha

[57] ABSTRACT

An interactive action game involving the selective collection of colored balls has a housing which supports a concave bowl with an electric battery motor driven foam paddle at the center of the concave surface. As the balls drop down to the center of the bowl, the balls contact the rotating foam paddle and are whirled about the concave surface of the bowl. Disposed over the top of the spinning foam paddle is a central shield. The top of the shield may contain a number of indentations, or separate pieces may be provided with indentations into which the players place the collected colored balls in a pattern to win the game.

14 Claims, 1 Drawing Sheet

WHIRLING BALL COLLECTING GAME

BACKGROUND OF THE INVENTION

1. Field of the Invention

This invention relates generally to games and more particularly to object collecting action games.

2. Background Art

Games in which the players try to collect balls or marbles from a common receptacle such as the Hasbro HUNGRY HUNGRY HIPPOS game disclosed in Todokoro U.S. Pat. No. 4,119,312 and the Milton Bradley STUFF YER FACE Game disclosed in Rehkemper, et al. U.S. Pat. No. 4,412,682 issued Nov. 1, 1983 have provided exciting and entertaining play. In both of these prior art games, the players have manipulated collectors mounted on the rim of a dished receptacle to collect the balls. Waski U.S. Pat. No. 4,111,429 issued Sept. 5, 1978 discloses a game in which players control a slide mechanism for random selection of marbles from a central hopper for placement in a coded game board. In Pearson U.S. Pat. No. 3,203,699 issued Aug. 31, 1965, a motor driven spinner positioned in the center of a dished out receptacle is controlled by a player to cause a ball or marble to move in a path that will selectively drop it in one of a number of arcuate troughs around the periphery of the receptacle. The game disclosed in Carrano, et al. U.S. Pat. No. 3,679,208 issued July 25, 1972, has a motor driven mechanism bouncing balls about inside of a spherical enclosure while players try to selectively catch the colored balls using a device inserted through a limited opening in the spherical container and place the balls in a pattern on a board that is provided. However, there remains a need for an action game in which players interact attempting to selectively collect colored balls or marbles from a common receptacle.

SUMMARY OF THE INVENTION

The present invention is concerned with providing a game in which a number of players compete to selectively collect colored balls whirling around in a concave receptacle using ball grabbing tubular collectors with push out plungers. A housing supports a concave bowl with an electric battery motor driven foam paddle at the center of the concave surface. As the balls drop down to the center of the bowl, the balls contact the spinning foam paddle and are whirled about the concave surface of the bowl. Disposed over the top of the spinning foam paddle is a central shield. The shield may contain a number of indentations, or separate pieces may be provided with indentations, into which the players place the collected colored balls in a particular pattern to win the game.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
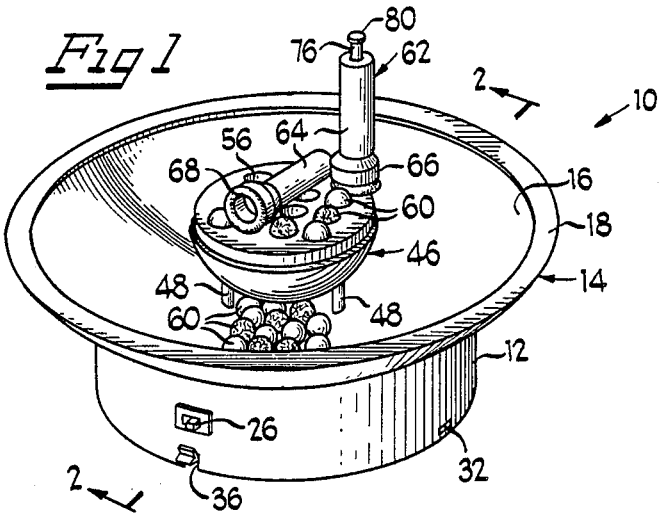
FIG. 1 is a perspective view of an embodiment of the present invention.
Figure 2:
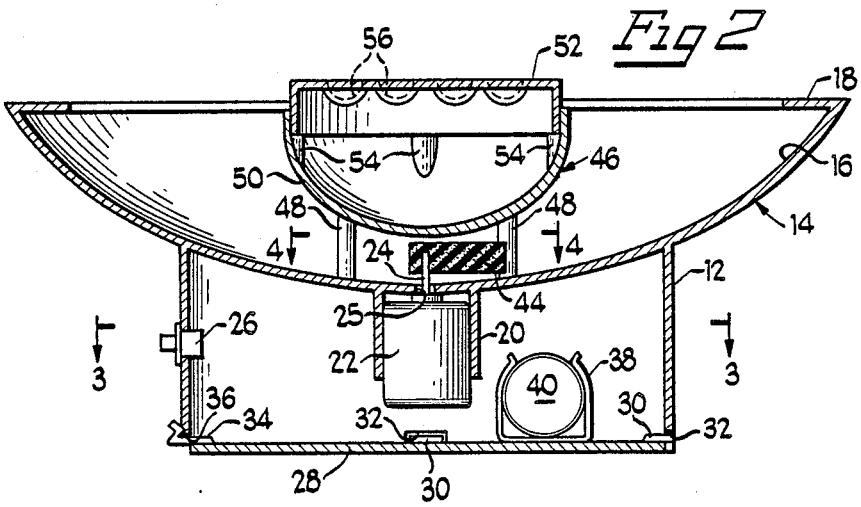
FIG. 2 is an enlarged scale, sectional view taken generally along line 2—2 of FIG. 1.

Referring now to the drawings in which like parts are designated by like reference numerals throughout the several views, FIG. 1 shows a game 10 including a cylindrical base housing 12. Atop base 12 is a bowl 14 providing a concave surface 16 with an upper, inwardly extending peripheral rim 18. Depending from the bottom of bowl 14 is a cylindrical casing 20. Base 12, bowl 14 and casing 20 have substantially the same central axes.

Mounted in cylindrical casing 20 is a DC motor 22 having an output shaft 24 extending up through a hole 25 in the bottom of bowl 14. Mounted through the side of tubular base housing 12 is an on/off switch 26. The bottom of housing 12 is provided with a circular closure plate 28 having three generally rigid tabs 30 that fit into spaced apart openings 32 in the side of tubular base housing 12. A spring tab 34 received in a notch 36, generally diametrically opposite one of the rigid tabs 30 and its mating slot 32, secures plate 28 at the bottom of the tubular housing. On the inside surface of plate 28 are two battery mounting clips 38. Each of the clips 38 removably receives a D cell battery 40. Wiring 42 connects batteries 40, on/off switch 26 and motor 22.

Figure 4:
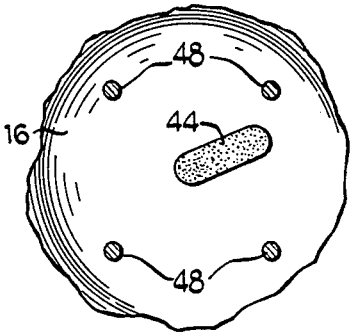
FIG. 4 is a fragmentary sectional view taken generally along line 4—4 of FIG. 2.

Secured to output shaft 24, for rotation with the shaft, is a paddle or arm 44 made of rubber or soft foam. Disposed within bowl 14, above paddle 44, is a central shield 46 having a curved, generally convex, bottom. Four spaced apart posts 48 are secured between concave surface 16 and the bottom of shield 46 by suitable adhesives or screws (not shown) to support shield 46 spaced above concave surface 16 and above the top of paddle 44. As is best illustrated in FIG. 4, each of posts 48 form the corner of a square and are spaced apart sufficiently from each other and shaft 24 so as not to interfere with the rotation of arm 44.

Shield 46 includes a cup member 50 atop which is a platform 52. Spaced apart bosses 54, which may be integrally formed on the inside of cup member 50, support platform 52. In the top, upwardly facing, surface of platform 52 are sixteen hemispherical indentations 56 in a four by four grid. Alternatively, indentations 56 may be provided in separate pieces (not shown).

Game 10 includes a plurality of balls 60 that are preferably distinguished by color into sets of the same number of balls for each player. Balls 60 are preferably made of a relatively hard material and have a smooth surface to reduce friction with concave surface 16. Marbles could be used as the balls. Accordingly, it is desirable to have paddle 44 made of a relatively softer, more resilient material to absorb some of the impact when the paddle hits the balls. Hemispherical indentations 56 are sized to receive balls 60. The diameter of the balls is less than the shortest distance between concave surface 16 and the bottom of central shield 46 and less than the space between any two adjacent posts 48 so that the balls readily pass beneath the shield and through the legs.

Each player is provided with a tubular ball grabbing collector 62 having a tubular handle portion 64 that is of a diameter and length to be comfortably grasped by the player. The bottom end of the collector is open and flared out to a diameter larger than that of balls 60. On the edge of bottom portion 66 is a rubber, or other resilient material, circular cuff 68. While the inside diameter of circular cuff 68 is less than the diameter of balls 60, cuff 68 deforms to permit a ball to pass through and then, because of the resiliency of the material forming the cuff urging the cuff to return to its original inside diameter, retains the collected ball.

Figure 5:
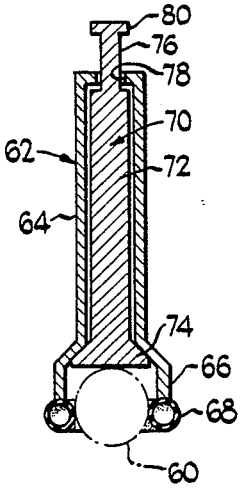
FIG. 5 is a central longitudinal sectional view of one of the tubular ball collectors shown in FIG. 1.
Figure 3:
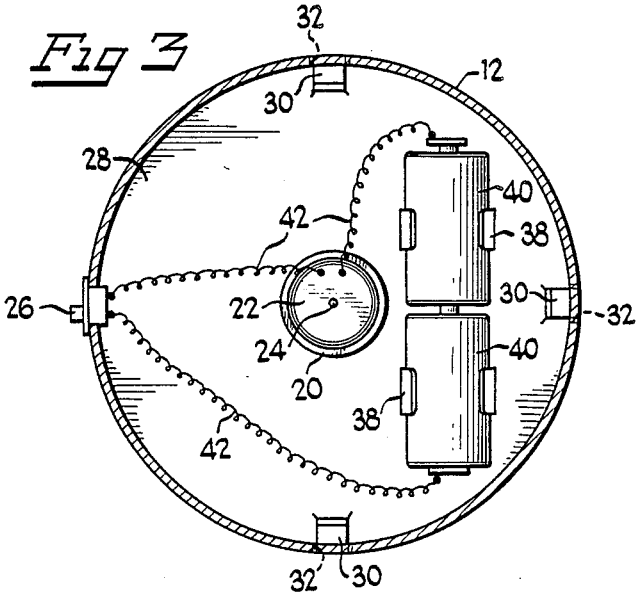
FIG. 3 is a sectional view taken generally along line 3—3 of FIG. 2.

Within tubular collector 62 is a plunger 70 having a main cylindrical portion 72, a flared out bottom part 74, a necked-down upper stem 76 that passes through an opening 78 in the top of collector 62, and a top cap 80 having a diameter larger than that of opening 78. Thus, plunger 70 is trapped for limited movement along the axis of the plunger and tubular collector 62 by virtue of the enlarged flared out bottom portion 74 and cap 80. When collector 62 is pushed down over a ball 60, plunger 70 is pushed up and the ball is retained within collector 62 as illustrated in FIG. 5. Downward pressure on plunger 70 will force ball 60 out of the collector.

To play the game, balls 60 are all put into bowl 14 and switch 26 is turned on. As the motor driven rotating paddle or arm 44 contacts a ball 60, it causes the ball to whirl about concave surface 16 in a counterclockwise manner as the game is viewed in FIG. 1. Inwardly extending rim 18 blocks the balls from being thrown out of the bowl. When the whirling ball slows down, it drops back toward the center of bowl 14 and is again hit by the rotating paddle.

While the balls are whirling about, each player attempts to obtain balls of a preselected color using a collector 62 to grab the ball. After a ball is in the collector, the player pushes down on plunger 72, which may be conveniently done with the player's thumb, to push the ball out and deposit it in one of the indentations 56 in the platform of shield 46. The first player to put four balls of a preselected color in a straight line, as in Tic Tac Toe, wins the game.

Although a particular embodiment of the present invention has been shown and described, changes and modifications will occur to those skilled in the art. It is intended in the appended claims to cover all such changes and modifications as fall within the true spirit and scope of the present invention.

What is claimed as new and desired to be secured by Letters Patent is:

1. A game comprising in combination:

a housing supporting a bowl providing an upwardly facing concave playing surface having a central, lowermost point;

a plurality of spherical balls;

means mounted for rotation about an axis generally coincident with the center of the concave playing surface;

means for driving the rotation means so that the rotation means will upon contacting a ball cause the ball to whirl about the concave playing surface;

means for retaining the whirling balls within the concave playing surface;

means for collecting the balls; and the balls collecting means being tubular with a resilient open bottom.

2. The game of claim 1 in which the ball collecting means include a plunger carried for movement within the tube for ejecting collected balls out of the resilient open bottom.

3. A game comprising in combination:

a housing supporting a bowl providing an upwardly facing concave playing surface having a central, lowermost point;

a plurality of spherical balls;

means mounted for rotation about an axis generally coincident with the center of the concave playing surface;

means for driving the rotation means so that the rotation means will upon contacting a ball cause the ball to whirl about the concave playing surface;

means for retaining the whirling balls within the concave playing surface;

a plurality of spaced apart posts extending upwardly from the concave playing surface;

the spaced apart posts being generally disposed around the rotation means; and the spaced apart posts supporting a shield disposed over the rotating means.

4. The game of claim 3 in which the shield has an upwardly facing surface having indentations for receiving the balls.

5. The game of claim 3 in which the rotation means comprises a paddle made of a material that is relatively soft and resilient as compared to the balls.

6. The game of claim 3 including means for collecting the balls.

7. The game of claim 6 in which the ball collecting means are tubular with a resilient open bottom.

8. The game of claim 7 in which the ball collecting means include a plunger carried for movement within the tube for ejecting collected balls out of the resilient open bottom.

9. The game of claim 3 in which the posts are spaced apart a distance greater than the diameter of any of the balls.

10. A game comprising in combination:

a housing supporting a bowl providing an upwardly facing concave playing surface having a central, lowermost point;

a plurality of spherical balls;

means mounted for rotation about an axis generally coincident with the center of the concave playing surface;

means for driving the rotation means so that the rotation means will upon contacting a ball cause the ball to whirl about the concave playing surface;

means for retaining the whirling balls within the concave playing surface;

a shield disposed over the rotating means; and the shield having an upwardly facing surface having indentations for receiving the balls.

11. The game of claim 10 in which the rotation means comprises a paddle made of a material that is relatively soft and resilient as compared to the balls.

12. The game of claim 10 including means for collecting the balls.

13. The game of claim 12 in which the ball collecting means are tubular with a resilient open bottom.

14. The game of claim 13 in which the ball collecting means include a plunger carried for movement within the tube for ejecting collected balls out of the resilient open bottom.

* * * * *